US008682224B2

(12) United States Patent
Stelter et al.

(10) Patent No.: US 8,682,224 B2
(45) **Date of Patent: *Mar. 25, 2014**

(54) METHOD FOR TRANSPORTING ELECTROPHOTOGRAPHIC DEVELOPER IN A PRINTER

(75) Inventors: Eric C. Stelter, Lexington, KY (US); Rodney R. Bucks, Webster, NY (US); Jerry E. Livadas, Webster, NY (US); Alan E. Rapkin, Pittsford, NY (US)

(73) Assignee: Eastman Kodak Company, Rochester, NJ (US)

( * ) Notice: Subject to any disclaimer, the term of this patent is extended or adjusted under 35 U.S.C. 154(b) by 121 days.

This patent is subject to a terminal disclaimer.

(21) Appl. No.: 13/245,111

(22) Filed: Sep. 26, 2011

(65) Prior Publication Data

US 2013/0078003 A1 Mar. 28, 2013

(51) Int. Cl.
*G03G 15/08* (2006.01)

(52) U.S. Cl.
USPC ..... 399/254

(58) Field of Classification Search
USPC ..... 399/254, 256, 258
See application file for complete search history.

(56) References Cited

U.S. PATENT DOCUMENTS

| | | | | |
|---|---|---|---|---|
| 4,996,565 | A | 2/1991 | Herley | |
| 7,212,772 | B2 | 5/2007 | Kasiske et al. | |
| 7,324,240 | B2 | 1/2008 | Ng | |
| 7,468,820 | B2 | 12/2008 | Ng et al. | |
| 7,634,215 | B2 * | 12/2009 | Imamura et al. | 399/254 |
| 2005/0281588 | A1 * | 12/2005 | Okuda et al. | 399/254 |
| 2008/0050667 | A1 | 2/2008 | Lobo et al. | |
| 2008/0159786 | A1 | 7/2008 | Tombs et al. | |
| 2011/0243584 | A1 * | 10/2011 | Fukuda | 399/30 |
| 2011/0311279 | A1 * | 12/2011 | Okazaki et al. | 399/254 |

FOREIGN PATENT DOCUMENTS

| | | | | |
|---|---|---|---|---|
| JP | 61-047977 | | | 3/1986 |
| JP | 08-220887 | A | * | 8/1996 |
| JP | 2000137383 | A | * | 5/2000 |
| JP | 2006195356 | A | * | 7/2006 |
| JP | 2006308964 | A | * | 11/2006 |
| JP | 2009180853 | A | * | 8/2009 |
| JP | 2010079116 | A | * | 4/2010 |
| JP | 2010139924 | A | * | 6/2010 |

* cited by examiner

*Primary Examiner* — Robert Beatty
(74) *Attorney, Agent, or Firm* — Nelson Adrian Blish

(57) ABSTRACT

A method for transporting developer in an electrophotographic printer with multiple augers includes transporting developer from a first channel to a development roller across at least a portion of the development roller; releasing spent developer from the development roller to a second channel; wherein the second channel has a first region having a first cross-sectional area and a second region having a second cross-sectional area; wherein the first region is a mixing region the second region is a transport region; and wherein the first cross-sectional area is larger than the second cross sectional area.

9 Claims, 4 Drawing Sheets

METHOD FOR TRANSPORTING ELECTROPHOTOGRAPHIC DEVELOPER IN A PRINTER

CROSS REFERENCE TO RELATED APPLICATIONS

Reference is made to commonly-assigned U.S. patent application Ser. No. 13/245,105 (now U.S. Publication No. 2013/0078002) filed Sep. 26, 2011, entitled ELECTROPHOTOGRAPHIC PRINTER DEVELOPMENT SYSTEM WITH MULTIPLE AUGERS, by Stelter et al.; the disclosure of which is incorporated herein.

FIELD OF THE INVENTION

The present invention relates to electrostatography, including electrography and electrophotography, and more particularly, to the design of a development system with multiple augers for an electrophotographic printer.

BACKGROUND OF THE INVENTION

The multi-channel development system used in electrophotographic printers has a development roller that moves developer containing marking particles (toner) into proximity with a primary imaging member, usually a photoconductor; and a first channel containing a feed auger, a second channel containing a mixing auger, and a third channel containing a return auger. The primary imaging member is used for forming an electrostatic image. The developer used in development systems of this type usually contains magnetic carrier particles and marking particles. The marking particles are removed from the development system to form an image on the primary imaging member.

The flow of developer through the three channel development system is such that developer is fed from the second channel to a first end of the feed auger in the first channel. As the developer travels longitudinally down the length of the feed auger, a portion of the developer is fed transversely from the feed auger to the development roller to produce a layer of developer on the development roller. The remainder of developer in the first channel continues to travel longitudinally down the length of the feed auger.

To produce a uniform image, the layer of developer on the development roller should be homogeneous and uniform along its length. The developer that is fed onto the development roller should contain marking particles that are at a constant concentration and have a uniform and narrowly distributed charge level. The developer that is fed to the development roller moves over the development roller and is not returned to the feed auger but instead drops into the return auger in the third channel. The used developer in the third channel has a toner concentration that is not uniform and is dependent on the image content of the image on the primary imaging member.

Developer moves longitudinally in the same direction in both the first channel and the third channel, from the first end of the augers to the second end, which is at the rear of the development system. At the rear of the development system, the developer collected by the third channel and the remaining developer in the first channel are both transported into the second channel. It is also at this point that replenishment marking particles are added to the developer to replace the marking particles that have been applied to the primary imaging member. The developer is moved longitudinally along the second channel by the mixing auger toward the first end of the feed auger. The developer that has traveled the length of the second channel is fed to the first end of the feed auger in the first channel, so that the developer is cycled continuously from the first channel to the development roller, from the development roller to the third channel, from the first and third channels to the second channel, and from the second channel to the first channel while the development system is running.

The mixing auger in the second channel needs to perform at least two functions. One function is to transport the developer that was collected from the second end of the first channel and second end of the third channel to the first end of the first channel. A second task is to mix the developer so that the developer that is delivered to the feed auger in the first channel is homogenous in marking particle concentration and marking particle charge. The developer that enters the second channel at the rear of the development system is a mixture of used developer from the third channel and the remaining developer that has traveled the length of the first channel. These two developer streams enter the second channel at the rear of the development system and it is at this point that replenishment marking particles are added. The used developer from the third channel, the unused developer from the first channel, and the replenishment marking particles need to be well mixed so that a homogeneous developer is presented to the first end of the feed auger, thus enabling the production of uniform, high-quality images. It is advantageous to have a means of thoroughly mixing the developer in the second channel while maintaining the necessary transport function of the mixing auger so that a homogeneous and steady supply of developer is provided to the first channel and the development roller.

SUMMARY OF THE INVENTION

Briefly, according to one aspect of the present invention, a method for transporting developer in an electrophotographic printer with multiple augers includes transporting developer from a first channel to a development roller across at least a portion of the development roller; releasing spent developer from the development roller to a second channel; wherein the second channel has a first region having a first cross-sectional area and a second region having a second cross-sectional area; wherein the first region is a mixing region the second region is a transport region; and wherein the first cross-sectional area is larger than the second cross sectional area.

The invention and its objects and advantages will become more apparent in the detailed description of the preferred embodiment presented below.

DETAILED DESCRIPTION OF THE INVENTION

The present invention will be directed in particular to elements forming part of, or in cooperation more directly with the apparatus in accordance with the present invention. It is to be understood that elements not specifically shown or described may take various forms well known to those skilled in the art.

Figure 1:
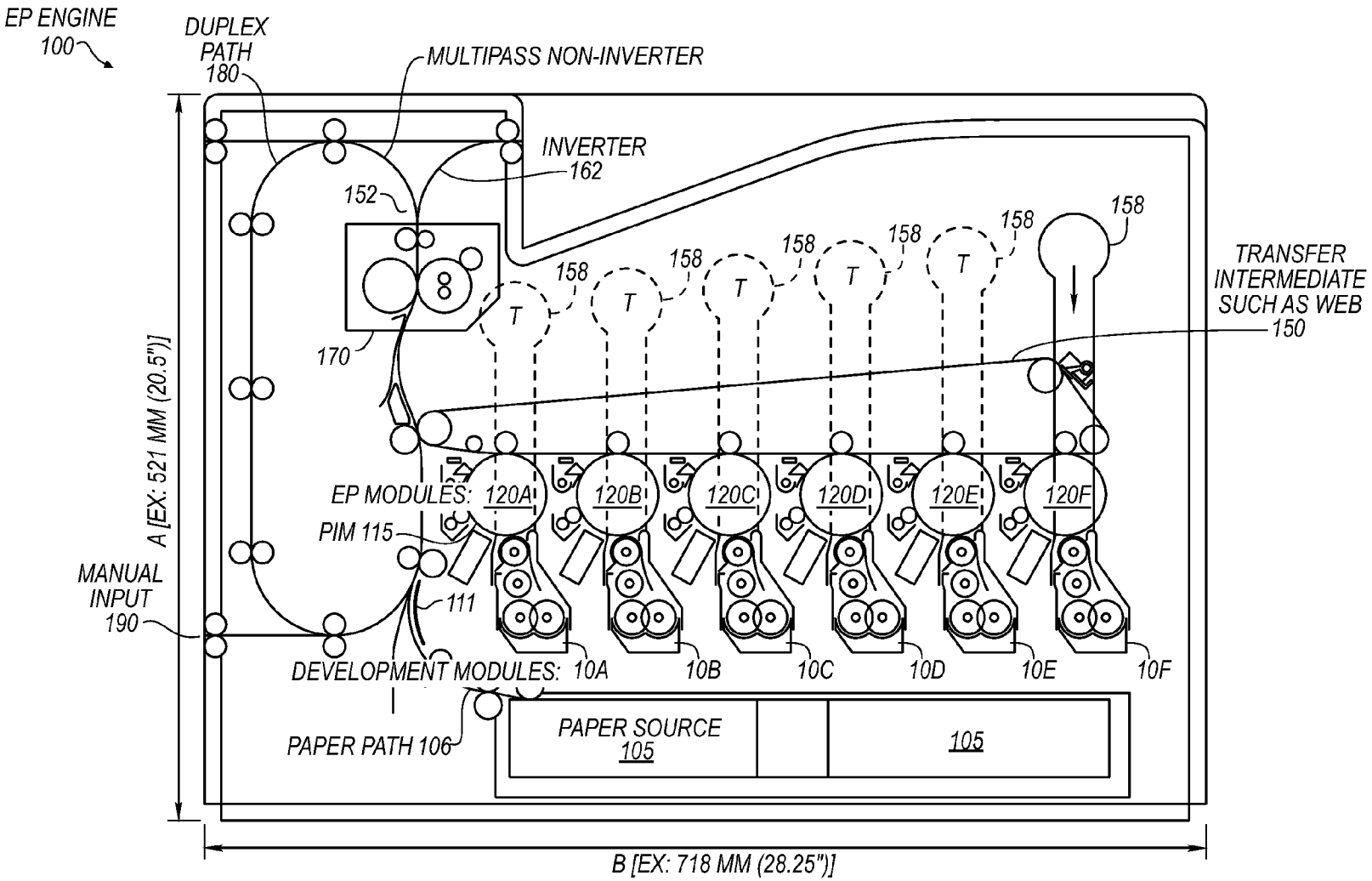
FIG. 1 is a cross-sectional view of an electrophotographic printer.

FIG. 1 shows an electrophotographic (EP) engine 100 or printer, often referred to as a tandem print engine including EP modules (120A, 120B, 120C, 120D, 120E, and 120F), wherein each contains a single primary imaging member (PIM) 115 and a single development system (10A, 10B, 10C, 10D, 10E, and 10F) to print on receiver 111. The EP printer is shown having dimensions of A×B which are around in one example, 521×718 mm. Four of the development stations, 10A, 10B, 10C, and 10D as an example, would typically contain marking particles that are typically used in most color prints. For example, marking particles of the subtractive primary colors cyan, magenta, yellow, and black would typically be contained in four of these development stations, and have typical optical densities such that a monolayer coverage (i.e. sufficient application of marking particles such that a microscopic examination would reveal a layer of marking particles covering between 60% and 100% of a primary imaging member) would have a transmission density in the primarily absorbed light color, as measured using a device such as an X-Rite Densitometer with Status A filters of between 0.6 and 1.0. The additional development systems can be used to print specialty marking particles that are commonly used for many applications, selectively determined by a control element. An individual operating or owning (hereafter referred to as the operator) the EP engine could control the control element and this effectively determines which specialty marking particles would print.

For example, a full-color image can be made using marking particles that function as ink containing typical cyan, magenta, yellow, and black subtractive primary colorants such as pigment particles or dyes. The marking particles are contained in a development system that develops an electrostatic latent image and is in proximity to a cylindrical primary imaging member or a frame of a primary imaging member in the form of a continuous web. Additional marking particles corresponding to specialty toners or inks are contained in one of a plurality of development systems, any one of which can be brought into proximity with a primary imaging member bearing an electrostatic latent image and convert that electrostatic latent image into a visible image. For example, the electrophotographic engine shown in FIG. 1 contains six print modules. Four of the modules would each contain a single development system containing marking particles of one of the four subtractive primary colors. As an example, the fifth and sixth EP modules 120E and 120F are shown with development systems, each containing marking particles having the function of a distinct specialty ink that can convert an electrostatic latent image into a visible image with only that specific specialty ink.

For example, if clear toner is commonly used as a marking particle by a particular EP engine, the fifth development system 10E could contain clear toner. Alternatively, other marking particles that would be commonly used throughout a variety of jobs can be contained in the fifth EP module. The sixth EP module 120F is also capable of selectively printing a specialty marking particle. Images produced with specialty marking particles include transparent, raised print, MICR magnetic characters, specialty colors and metallic toners as well as other images that are not produced with the basic color marking particles.

Another example can be described for the use of white toner as a specialty toner. The first development system, 10A, could contain white toner. In this example the white toner would be the last marking particle added to the toner deposit on the intermediate transfer member (ITM) 150. Upon transfer to the receiver 111, the white toner would be on the bottom of the toner stack against the paper and allow the formation of a subtractive colorant image on a colored paper by building the image on top of an image-wise deposit of the white toner. Development systems 10B, 10C, 10D, and 10E could contain marking particles with the typical subtractive colorants and 10F could contain a second specialty toner such as clear.

Development systems suitable for use in this invention include dry development systems containing two component developers such as those containing both marking particles and magnetic carrier particles. The development systems used for two component development can have either a rotating magnetic core, a rotating shell around a fixed magnetic core, or a rotating magnetic core and a rotating magnetic shell. It is preferred that the marking particles used in practicing this invention are toner that is a component of dry developer. Marking particles are removed from the development system when images are printed. Replacement marking particles are added to the development systems 10A-10F by replenishment stations 158, each of which contains the appropriate marking particle.

In the example shown in FIG. 1, after each development system develops the electrostatic latent image on the primary imaging member (PIM) 115, thereby converting the electrostatic latent image to a visible image, each image is transferred, in register, to an intermediate transfer member 150. The ITM can be in the form of a continuous web as shown or can take other forms such as a drum or sheet. It is preferable to use a compliant intermediate transfer member, such as described in the literature, but noncompliant ITMs can also be used.

The receiver sheets are held in the printer at a paper tray (paper source) 105 and, in the example shown, enter the paper path 106 so as to travel initially in a counterclockwise direction. The paper could also be manually input via the manual input 190 from the left side of the electrophotographic engine. The printed image is transferred from the ITM to the receiver and the image bearing receiver then passes through a fuser 170 where the image is permanently fixed to the receiver. The image then enters a region where the receiver either enters an inverter 162 or continues to travel counterclockwise. If the receiver enters the inverter, it travels clockwise, stops, and then travels counterclockwise back onto the duplex path 180. This inverts the image, thereby allowing the image to be duplexed. Prior to the inverter is a diverter 152 that can divert the receiver sheet from the inverter and sends it along the paper path in a counterclockwise direction. This allows multiple passes of the receiver on the simplex side, as might be desired if multiple layers of marking particles are used in the image or if special effects such as raised letter printing using large clear toner are to be used. Operation of the diverter to enable a repeat of simplex and duplex printing can be visualized using the duplex path 180 shown in FIG. 1.

It should be noted that, if desired, the fuser 170 can be disabled so as to allow a simplex image to pass through the fuser without fusing. This might be the case if an expanded color gamut in simple printing is desired and a first fusing step might compromise color blending during the second pass through the EP engine. Alternatively, a fusing system that merely tacks, rather than fully fuses an image and is known in the literature can be used if desired such as when multiple simplex images are to be produced. The image can also be sent through a subsystem that imparts a high gloss to the image, as is known in the literature and is described in co-owned U.S. Pat. Nos. 7,212,772; 7,324,240 and 7,468,820 as well as U.S. Publication Nos. 2008/0159786 and 2008/0050667, which are hereby incorporated by reference.

Figure 2:
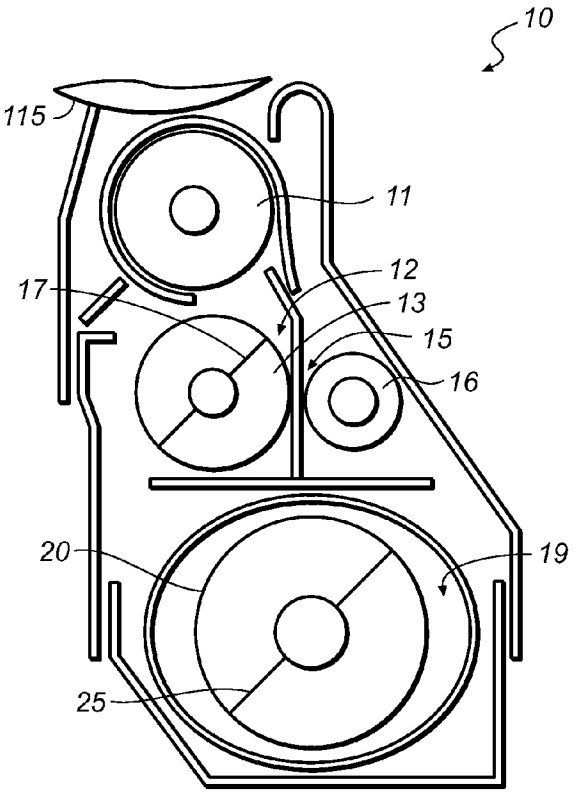
FIG. 2 is a transverse cross-sectional view of a development system for an electrophotographic printer according to an embodiment of the invention.
Figure 3:
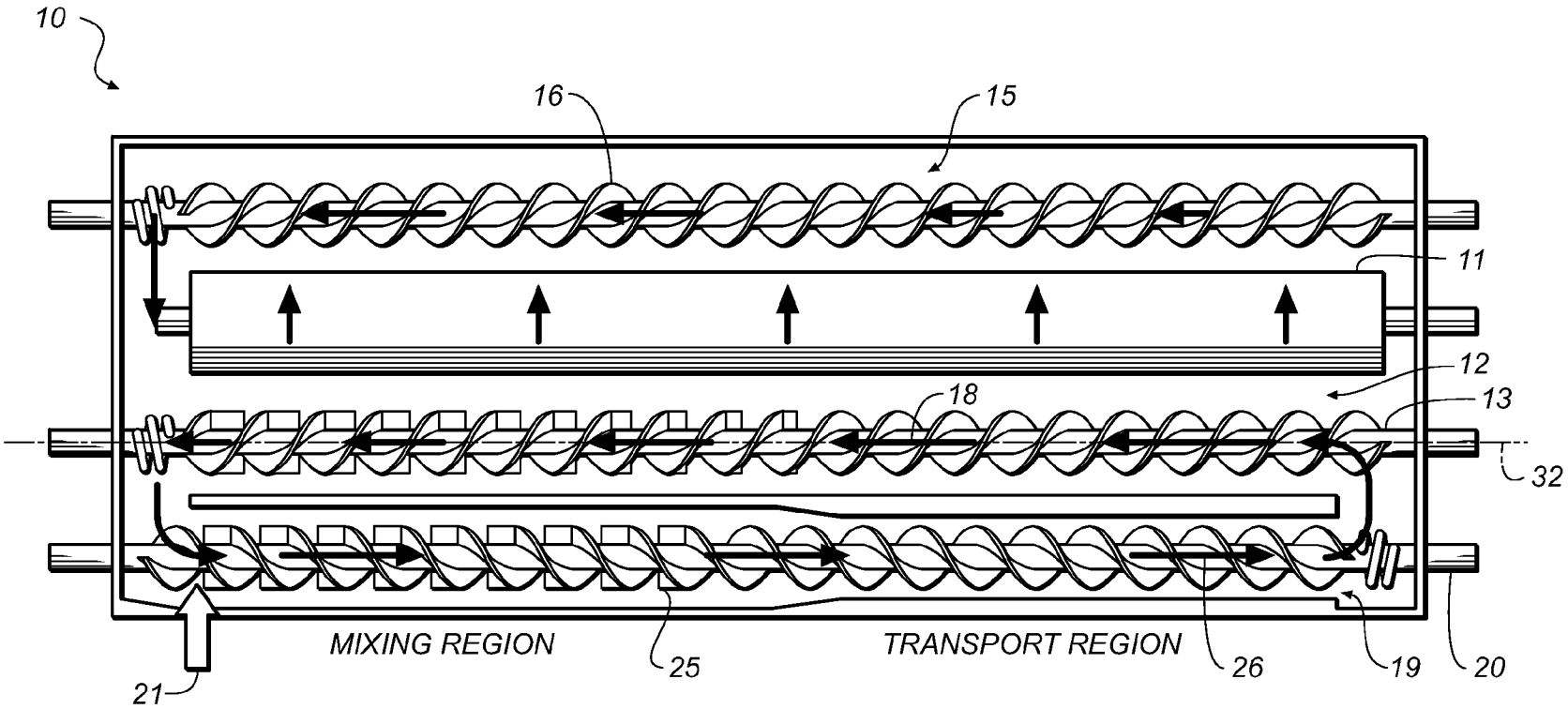
FIG. 3 is a longitudinal cross-sectional schematic view of a development system for an electrophotographic printer according to an embodiment of the invention.

Referring now to FIG. 2 and FIG. 3, an arrangement of paddles are shown on the mixing auger of development system 10 that assist the mixing of developer in the second channel. FIG. 2 is a transverse cross-sectional view of a development system 10 for an electrophotographic printer according to an embodiment of the invention. A development roller 11 is adjacent a feed auger 13 in a first channel 12. Two of a plurality of paddles 17 on the feed auger are shown in the cross-section of feed auger 13. Developer is fed from the first channel 12 to the development roller 11, is moved to proximity with primary imaging member 115, and drops into third channel 15 with return auger 16. At the rear of the development system, the developer collected by the third channel 15 and the remaining developer in the first channel 12 are both dropped into the second channel 19, where the mixing auger 20 moves the developer to the front of the station, where it is fed to the first end of the feed auger 13 in the first channel 12. The cross-sectional view is of a region that is optimized for developer mixing. Two of a plurality of paddles 25 on the mixing auger are shown in the cross-section of mixing auger 20. The paddles on the mixing auger are added to the mixing auger in this region to disrupt the longitudinal flow of developer and provide for the addition of mechanical agitation to the developer so that good mixing of the used developer from the third channel, the remaining developer in the first channel, and the replenishment toner can occur. Mechanical agitation is necessary both for physical mixing of the two developer streams and the replenishment marking particles to provide a homogeneous developer, but also for tribocharging of the marking particles. The marking particles gain the electrostatic charge necessary to develop the electrostatic latent image on the primary imaging member by mechanical interaction with the magnetic particles in the developer. The mechanical agitation provided by the paddles added to the mixing auger allows for many interaction events between the magnetic carrier particles and the marking particles. This produces the uniformly charged marking particles that are required to produce uniform, high-quality images. The cross-section of the second channel 19 in this region also shows that the cross-sectional area of the second channel is larger than the cross-sectional area of the mixing auger and is designed to provide a volume around the mixing auger where mixing can occur. The larger volume of the second channel relative to the mixing auger in this region of the channel creates a zone where the circulating mass flow of developer is maintained while decreasing the average developer velocity. This decrease in the average developer velocity allows for more mixing time and more tribocharging marking particle to magnetic carrier particle interactions than would be possible if the cross-sectional area of the channel in this region was not made larger.

FIG. 3 is a longitudinal, cross-sectional, schematic view of a development system for an electrophotographic printer according to an embodiment of the invention that shows a direction of developer flow 18 in the first channel 12 along an axis of the feed auger 32. The decreasing volume of developer in the first channel 12 is indicated by the decreasing length of the arrows 18 in the direction of developer flow. Uniform flow of developer over the development roller 11 is indicated by similar arrows of the same size. Increasing volume of developer in the third channel 15 is indicated by the increasing length of the arrows in the direction of developer flow. The arrows also indicate that developer from the first channel and the third channel is collected in the second channel 19, where it is mixed and fed to the first channel. Replenishment marking particles 21 are also added to the second channel at the rear of the development system. As an example of one embodiment of the invention, the second channel 19 is divided into two regions, a mixing region that is optimized for mixing of the developer and a transport region that is optimized for transport of the developer. A plurality of paddles 25 is attached to the mixing auger 20 in the "mixing region" to facilitate mixing of the used developer from the third channel, the remaining developer from the first channel, and the replenishment marking particles. These paddles generate transverse movement of the developer and provide for significant mechanical agitation in the mixing region. The cross-sectional area of the second channel 19 is also larger in the mixing region of the second channel than in the transport region of the second channel. The increased cross-sectional area in the mixing region provides a volume in which mixing of developer can occur. There are no paddles in the transport region of channel 19 and the cross-sectional area of the channel closely matches the cross-sectional area of the auger; that is, the cross-sectional area of the second channel 19 is smaller in the transport region of the channel than in the mixing region of the channel. The lack of paddles and the lack of mixing volume in the transport region of the second channel provide for the efficient transport of developer in the direction of developer flow 26 by the mixing auger in the transport region. The efficient transport of developer in this region assists in the transfer of developer from the second channel to the feed auger in the first channel.

Figure 4A:
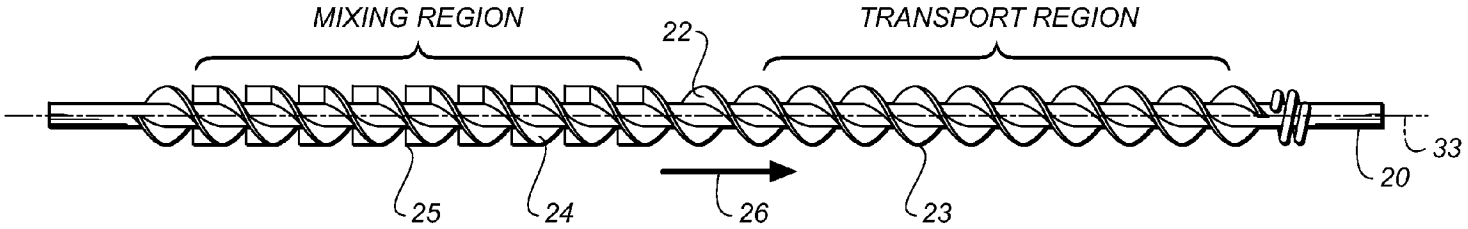
FIG. 4A is a perspective view of mixing augers according to embodiments of the invention.
Figure 4B:
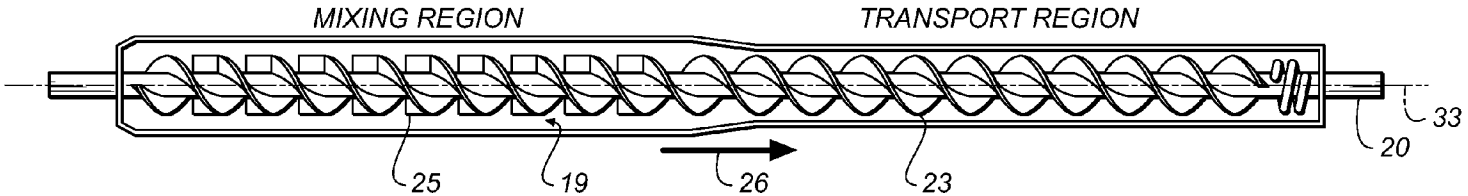
FIG. 4B is a perspective view of a mixing auger and a top cross sectional view of the second channel according to an embodiment of the invention

Referring now to FIG. 4A and FIG. 4B, an arrangement of paddles are shown on the mixing auger 20 that assist the mixing of developer in the mixing region of channel 19. FIG. 4A is a perspective view of a mixing auger 20 and FIG. 4B is a view of the same mixing auger shown in FIG. 4A that also shows the cross-section of channel 19. Each auger flight 23 forms a helix. There are two auger flights on mixing auger 20. As the auger rotates to move developer from the rear end of the development system to the front end of the development system in a direction of developer flow 26, the developer is moved by a working face 24 of the auger flights. Paddles are placed on the trailing face 22 of the auger flights to provide transverse mechanical agitation without significantly reducing the developer transport provided in the direction of developer flow 26 by the working auger face 24. These paddles are added to the mixing auger 20 in the mixing region of the second channel 19.

Figure 4D:
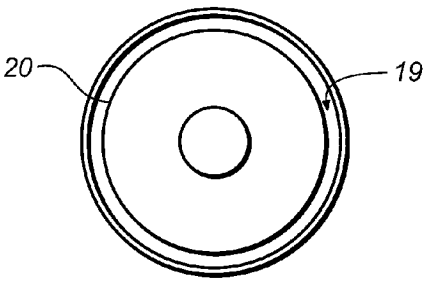
FIG. 4D is a transverse cross-sectional view of the mixing auger and the second channel in a region that is optimized for developer transport according to an embodiment of the invention
Figure 4C:
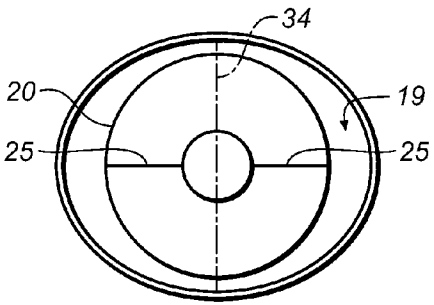
FIG. 4C is a transverse cross-sectional view of the mixing auger and the second channel in a region that is optimized for developer mixing according to an embodiment of the invention

Referring now to FIG. 4C and FIG. 4D, schematic, cross-sectional views of the second channel 19 and the mixing auger 20 in the mixing region, FIG. 4C, and the transport region, FIG. 4D. FIG. 4C shows the larger cross-sectional area of the second channel and the addition of paddles to the auger in the mixing region. FIG. 4D shows the closely matched cross-sectional area of the mixing auger 20 and the second channel 19 in the transport region.

As shown in FIG. 4A and FIG. 4B, in a preferred embodiment of the invention, a paddle is added to each pitch of both auger flights of the mixing auger in the mixing region such that the paddles on the two flights are 180° opposed around the axis of the mixing auger 33. The 180° arrangement is illustrated in FIG. 4C. However, other paddle and auger configurations can be employed on the mixing auger that will also generate improved mixing in the mixing zone of the second channel.

FIG. 4C shows a preferred embodiment of the invention where the second channel 19 in the mixing zone is elliptically shaped with the minor axis of the ellipse 34 oriented in a vertical direction. This shape increases the volume of the second channel without the creation of zones where the developer will become stagnant. Gravity assists to move developer from the volume that is not swept by the auger flights to the area that is swept by the auger flights. This cross-section shape also allows for the close approach of the second channel to the first channel in the region where developer must be transferred from the second channel to the first.

The invention has been described in detail with particular reference to certain preferred embodiments thereof, but it will be understood that variations and modifications can be effected within the scope of the invention.

The invention claimed is:

1. A method for transporting developer in an electrophotographic printer with multiple augers comprising:

transporting developer from an elliptically-shaped first channel to a development roller across at least a portion of the development roller;

releasing spent developer from the development roller to a second channel having a first mixing region with a first cross-sectional area and a second transport region with a second cross-sectional area; and the first cross-sectional area being larger than the second cross sectional area.

2. The method of claim 1 wherein the mixing comprises rotating a mixing auger with paddles.

3. The method of claim 1 wherein replenishment toner is added to the second channel.

4. The method of claim 1 wherein the developer comprises magnetic particles and marking particles.

5. A method for electrophotographic printing with multiple augers comprising:

feeding developer from an elliptically-shaped first channel containing a feed auger to a development roller;

transporting developer across at least a portion of the development roller;

releasing developer from the development roller to a second channel having a first mixing region with a first cross-sectional area containing a mixing auger; and having a second transport region with a second cross-sectional area and the first cross-sectional area being larger than the second cross-sectional area.

6. The method of claim 5 wherein the mixing auger comprises paddles.

7. The method of claim 5 wherein the mixing auger comprises paddles in the first region.

8. The method of claim 5 wherein replenishment toner is added to the second.

9. The method of claim 5 wherein the developer comprises magnetic particles and marking particles.

* * * * *